United States Patent [19]

Bayer

[11] Patent Number: 4,555,688

[45] Date of Patent: Nov. 26, 1985

[54] THERMOSTAT FOR COOKING UTENSIL

[75] Inventor: Helmut Bayer, Vienna, Austria

[73] Assignee: Electrovac, Fabrikation elektrotechnischer Spezialartikel Gesellschaft mbH, Vienna, Austria

[21] Appl. No.: 628,532

[22] Filed: Jul. 6, 1984

[30] Foreign Application Priority Data

Jul. 7, 1983 [AT] Austria ..... 2507/83

[51] Int. Cl.[4] ..... H05B 1/02

[52] U.S. Cl. ..... 337/394; 219/449; 219/512; 337/388

[58] Field of Search ..... 219/447, 450, 451, 452, 219/453, 464, 512; 337/382, 386, 388, 393, 394

[56] References Cited

U.S. PATENT DOCUMENTS

| | | | |
|---|---|---|---|
| 3,732,518 | 5/1973 | Them et al. | 337/394 |
| 3,906,424 | 9/1975 | Clancy et al. | 337/394 |
| 4,215,332 | 7/1980 | Wharton | 337/394 |
| 4,267,815 | 5/1981 | Gössler | 126/39 G |
| 4,347,432 | 8/1982 | Gössler | 219/449 |
| 4,350,875 | 9/1982 | McWilliams | 219/449 |
| 4,400,679 | 8/1983 | Snider | 337/382 |
| 4,430,558 | 2/1984 | McWilliams | 219/449 |

FOREIGN PATENT DOCUMENTS

| | | | |
|---|---|---|---|
| 982826 | 2/1976 | Canada | 337/394 |
| 2748109 | 5/1979 | Fed. Rep. of Germany | 219/449 |
| 3100758 | 9/1982 | Fed. Rep. of Germany | 219/449 |
| 2369674 | 12/1977 | France | 337/394 |
| 715922 | 9/1954 | United Kingdom | 337/394 |

*Primary Examiner*—Volodymyr Y. Mayewsky
*Attorney, Agent, or Firm*—Martin A. Farber

[57] ABSTRACT

A thermostat for a cooking utensil having a radiation heating body is constructed of an electrical switch actuated by a push rod. The rod extends away from the switch and expands in response to increasing temperature. The rod is held by spring loading within an outer tube of material, typically quartz or ceramic, of substantially lower coefficient of expansion than the rod. To permit adjustment of the thermostat during manufacture, a mating surface between a side wall of a housing of the switch and an end of the tube is constructed by forming an outward spherically shaped bulge in the side wall and an outward flaring of the end of the tube, thereby to permit relative motion between the housing and the tube without fracturing the end of the tube.

9 Claims, 6 Drawing Figures

THERMOSTAT FOR COOKING UTENSIL

The present invention refers to a device for regulating or limiting at least one temperature value or one temperature range of radiation or contact heating bodies of electrical cooking apparatus in combination with cooking surfaces consisting of metal, glass ceramics or the like, in which at least one temperature sensor is arranged between the heating body and the cooking surface in order to regulate or limit the temperature of the heating body or bodies, said temperature sensor having a rod of high thermal expansion arranged within a tube of low thermal expansion, one end of the rod being in communication with a switch system which serves for regulating or limiting the temperature of the heating body and the one end of the tube resting against a side wall, arranged approximately perpendicular to the rod, of the switch housing surrounding the switch system.

The regulating or limiting of the temperature is effected in one device of the above type in particular in the manner that the temperature-produced axial movement of the rod-shaped temperature sensor is used to actuate the switch system in such a manner that the heating circuit is connected at one given temperature and disconnected at a given higher temperature.

The tube which surrounds the rod consists of a material which is resistant to high temperatures and has a low coefficient of thermal expansion and it holds the rod against the axially-extending resistance of a coil spring, whereby the tube is under axial compressive stress. This leads to difficulties—particularly upon installation—if the device for the regulating of the temperature must be adjusted in position after installation. This is done by slightly swinging the free end of the rod which is remote from the switch housing. These adjustment movements, however, frequently cause a splintering of the quartz-glass tube at the end of the tube adjoining the switch housing.

Other embodiments are also known in which the quartz-glass tube is inserted into a metal mount which rests on a spherical bulge. Upon tilting of the glass tube however splintering may occur also within the mount as a result of the tolerances. Furthermore, in view of the high frictional values, lubrication must be effected. If the frictional values are too high because of deficient lubrication, the tube will frequently break.

The object of the present invention is to create a device of the abovementioned type for regulating or limiting at least one temperature value of heating bodies which device permits simple displacement or adjustment of the rod while retaining the original shape of the tube, and particularly of its end regions.

In accordance with the invention this object is achieved in the manner that the end of the tube which rests against the side wall has a funnel-shaped increase in diameter and the side wall is provided in this region, in order to form a joint, with a spherical bulge which extends into the enlarged diameter.

By such a simple development, high assurance against breakage of the tube is obtained without other, auxiliary means which impair the precision of the switching, thus considerably simplifying the adjustment. As a result of the low frictional values between glass and metal, no lubrication or the like is necessary either. The embodiment is particularly economical due to the relatively simple manufacture of the tube as well as the fact that it consists of a single piece.

Another advantageous embodiment of the invention resides in the fact that the increase in diameter in the end region of the tube amounts to at least twice the inside diameter of the tube which surrounds at least part of the rod, the line of contact with the spherical side wall lying in the end region of the enlarged section of the tube, as a result of which a larger surface of contact between the end of the tube and the spherical bulge of the switch housing can be obtained and thus also less pressure per unit of area, and tilting of the tube can be dependably prevented.

Another variant of the embodiment of the invention is characterized by the fact that at the time of the switch actuation the center of the circumscribed circle which can be drawn around the end of the rod which is within the switch housing corresponds to the center of a circle which can be inscribed in the funnel-shaped enlargement of the diameter.

With such a development, even relatively extensive swinging of the rod together with the tube can be effected without in any way impairing the precision of the switching.

Finally, in accordance with another advantageous embodiment of the invention, the length of the enlargement of the diameter of the tube in its longitudinal direction can correspond at least to about one to about three times its inside diameter, thus obtaining a flat rise of the widened ends of the tube, which increases the strength.

The invention will be described below by way of example with reference to the drawings.

FIG. 1 is a view in elevation of the device;

FIG. 2 an enlarged cross section through the end of the tube.

Figure 1:
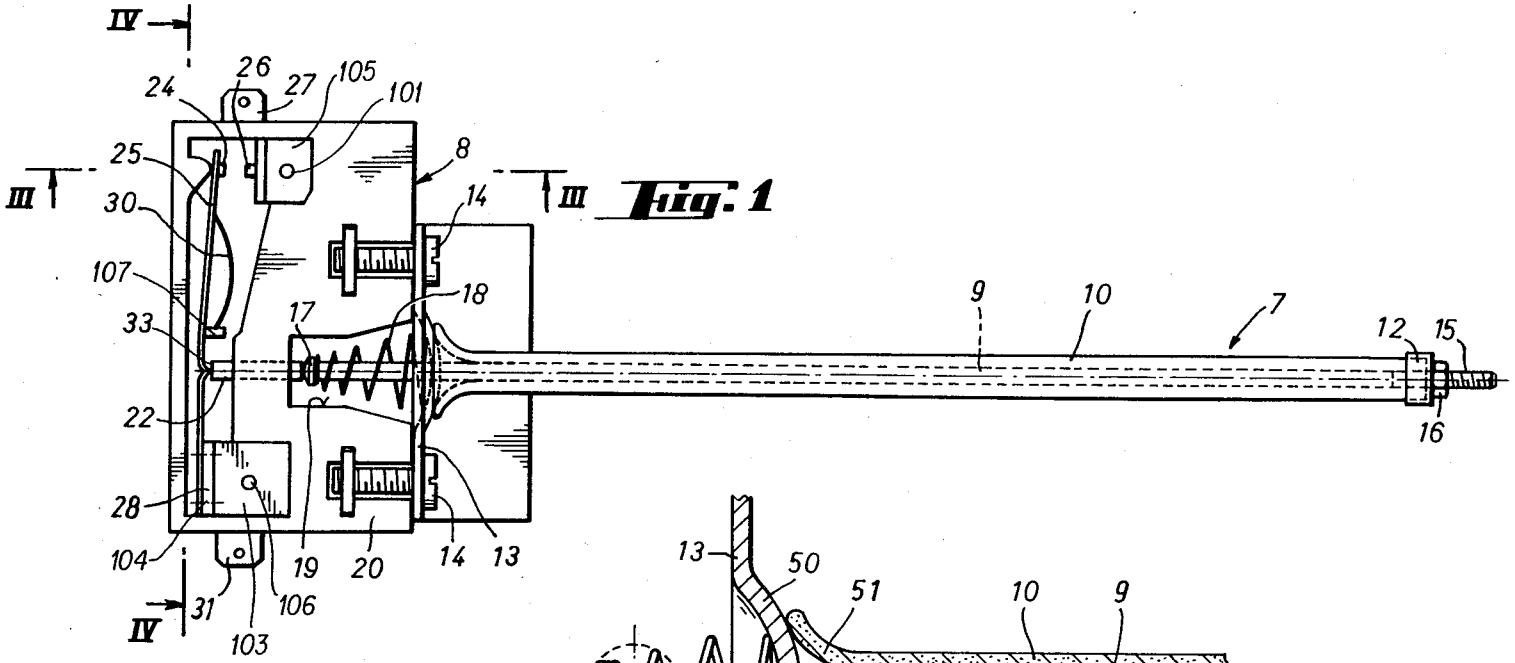

Referring to FIG. 1, a temperature sensor 7 is in communication with a switch housing 8 which contains the switch system, the temperature sensor 7 passing in simple manner through a hole in a radiation heating body 3 of conventional design (not shown).

The temperature sensor 7 is exposed to the temperature which prevails below the cooking surface in the radiation space between the cooking surface and the heating coil.

The temperature sensor 7 has a rod 9 consisting of a material which has a high resistance to temperature and a high coefficient of thermal expansion, for instance a nickel-chromium alloy or an FeCr alloy, arranged within a tube 10. The tube consists of a material of high temperature resistance and low coefficient of thermal expansion, for instance quartz glass or ceramics, and forms a covering for the rod 9. The rod 9 is passed through holes in a cap 12 and a side wall 13 of the switch housing 8 and is provided on the end located at the cap 12 with a thread 15 onto which there is screwed a nut 16 which rests against the cap 12. The other end of the rod 9 has a bulged collar 17. Between the collar 17 and the side wall 13 and thus between the collar 17 and the one end of the tube 10 which contains the rod 9, there is a spring 18 which is in compression and which holds the rod under tensile stress and thus presses the nut 16 against the outside of the cap 12.

The rod 9, the tube 10, the cap 12, the nut 16, the side wall 13 and the compressed spring 18 form the temperature sensor which is screwed by screws 14 to the switch housing 8 which has a recess 19 into which the end of the rod 9 bearing the compressed spring 18 is inserted.

The switch housing 8 has a side which is open towards the top, which can be covered by a cover plate. The inside of the switch housing 8 is in communication with the cutout 19 via a bore hole which extends at least approximately coaxially to the rod 9 and within which there is a transmission member 22 which is axially displaceable within the bore. The one end of the transmission member 22 rests against the curved surface of the collar 17.

The transmission member 22 has an actuating surface 33 to actuate the switch system which serves for the regulating or limiting of the temperature, said system having a contact spring 25 which bears the movable contact 24 and a connection lug 27 bearing the fixed contact 26. The contact spring 25 is firmly connected to a spring holder 28 which also bears the contact spring 30, is connected in electrically conductive manner with a connection lug 31 and is fastened to the switch housing 8 by a rivet.

In the condition shown in FIG. 1, the contacts 24, 26 are open and the heating circuit is thus disconnected.

If the heating circuit is connected to supply voltage, the heating coil of the heating body is heated, as a result of which the temperature within the space between the cooking surface and the heating coil increases. The rod 9 expands so that the transmission member 22 is moved towards the point of actuation of the contact spring 25. When the temperature in the space between the cooking surface and the heating coil reaches a value, for instance, of 700° C., the actuating surface 33 of the transmission member 22 strikes against the contact spring 25, whereby the contacts 24, 26 are abruptly opened so that the heating is disconnected. When the rod 9 decreases in length during the course of its following cooling, the contact spring 25 snaps back into the position in which the contacts 24, 26 are closed.

This cycle is repeated as long as the heating circuit is connected to the supply voltage. When it is disconnected from it, the contacts 24, 26 will, it is true, close during the course of the cooling but no new heating will take place, so that the rod 9 becomes shorter and shorter.

As mentioned, the adjustment of the switch system 24, 26 for a given temperature which is to be produced by the foregoing heating body is effected by turning the nut 16 on the thread of the rod 9. However, any other known method or means of adjustment can, of course, be used, such as adjustable screws, squeeze plates or the like.

Figure 2:
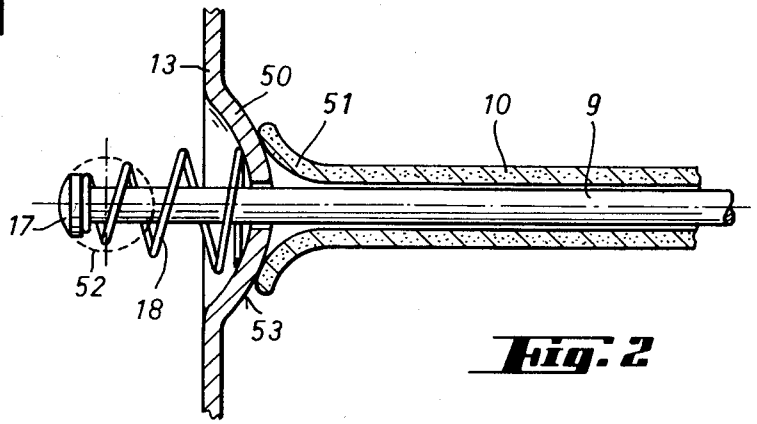
Figure 3:
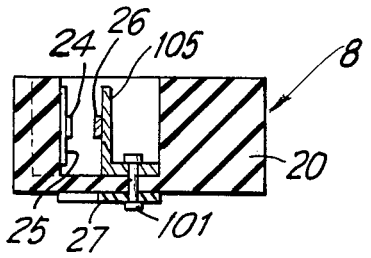
FIG. 3 and FIG. 4 are sectional views taken along the lines III—III and IV—IV in FIG. 1.
Figure 4:
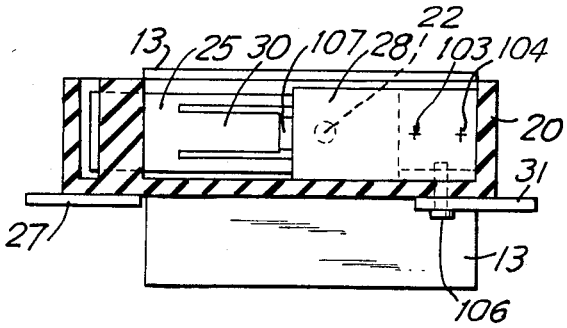
Figure 5:
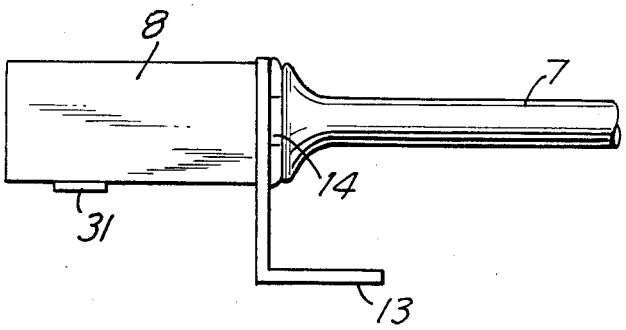
FIG. 5 is a simplified side view of a portion of the device.
Figure 6:
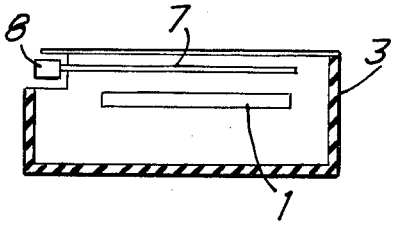
FIG. 6 is a stylized side view of the device with the temperature sensor positioned in proximity to a heating body.

As shown on a larger scale in FIG. 2, the side wall 13 of the switch housing 8 has a spherical bulge 50 directed outwards towards the tube 10. The end 51 of the tube 10 which end has a funnel-shaped enlargement in diameter is pressed by the action of the coil spring 18 against the outside of said bulge 50. A circle 52 circumscribed around the curved surface of the collar 17 has the same center as a circle 53 inscribed in the inner surface of the funnel-shaped tube end 51, said inscribed circle at the same time forming the curvature of the spherical bulge 50. As a result of this joint-like development, the rod 9 together with the tube 10 can be moved for adjustment relative to the stationarily mounted switch housing 8 or be swung around the center of the inscribed circle.

As can be seen from FIGS. 1–6, the construction of the contact housing 8 is extremely simple. The contact housing comprises an electrically insulating ceramic housing body 20 which has four recesses, which open toward the top, for receiving the screws 14, the spring 18, and the contact spring 25—as it is shown, for example, in Section III—III of FIG. 3 for receiving the contact spring 25. The two connecting lugs 27, 31, by means of the electrically conductive rivet 101 and 106, respectively, are connected to an electrically conductive angularly-shaped part 105 and 103, respectively. The angular part 103, by means of the schematically shown attachments 104, is connected with the spring support 28. This spring support 28 has a nose 107 which is hooked at a right angle, which is provided to hold the contact spring 30, the contact spring 30 being connected with the contact spring 25. The transmission member 22 is mounted displaceably in a horizontal bore which connects to the recess 19 for the spring 18 and the recess for receiving the contact spring 25. It is common practice to fabricate the housing 20 and member 22 in an electrically insulating manner. The side wall 13 is designated as side wall because it covers the recess 19 laterally. The side wall 13 is attached to the switch housing 8 by means of the two screws 14. The simple construction is apparent from the sectional views of the switch housing.

It is to be understood that the above-described embodiment of the invention is illustrative only, and that modifications thereof may occur to those skilled in the art. Accordingly this invention is not to be regarded as limited to the embodiment disclosed herein; but is to be limited only as defined in the appended claims.

I claim:

1. A device for regulating temperature of radiation and contact heating bodies and electrical cooking apparatus in combination with cooking surfaces consisting of metal, glass ceramics and the like, in which at least one temperature sensor and switch system are provided in order to regulate the temperature of the heating body between the heating body and the cooking surface, said sensor having a rod of high thermal expansion which is disposed in a tube made of low thermal expansion, the switch system being enclosed within a switch housing, one end of the rod being in communication with the switch system which serves to regulate the temperature of the heating body, one end of the tube resting against a side wall of the switch housing, the side wall being oriented approximately perpendicular to the rod, a second end of the rod and a second end of the tube being joined together at a location distant from the switch housing to form the sensor, the improvement wherein the end of the tube which rests against the side wall has a funnel-shaped enlargement in diameter and the side wall has a spherical bulge which extends into the enlargement of the diameter to contact directly the material of the tube so as to form a joint in this region;

the bulge having a hole for entry of the one end of the rod into the switch housing, the device including spring means connecting between an interior side of said bulge and the one end of the rod for securing the sensor to the housing, and wherein electrically conducting elements of the switch system are electrically insulated from said sensor.

2. The device according to claim 1, wherein the enlargement in diameter in the end region of the tube amounts at least to twice the inside diameter of the tube which at least in part surrounds the rod, the line of contact with the spherical bulge in said side wall lying in the end region of the enlarged section of the tube.

3. The device according to claim 1, wherein at the time of switch actuation, the center of a circumscribed circle which can be drawn around the one rod end located within the switch housing corresponds to the center of a circle which can be inscribed in the funnel-shaped enlargement of the diameter.

4. The device according to claim 3, wherein the length of the enlargement of the diameter of the tube corresponds in its longitudinal direction at least to about one to about three times its inside diameter.

5. The device according to claim 2, wherein the length of the enlargement of the diameter of the tube corresponds in its longitudinal direction at least to about one to about three times its inside diameter.

6. The device according to claim 2, wherein at the time of switch actuation, the center of the circumscribed circle which can be drawn around the one rod end located within the switch housing corresponds to the center of a circle which can be inscribed in the funnel-shaped enlargement of the diameter.

7. The device according to claim 6, wherein the length of the enlargement of the diameter of the tube corresponds in its longitudinal direction at least to about one to about three times its inside diameter.

8. The device according to claim 1, wherein the length of the enlargement of the diameter of the tube corresponds in its longitudinal direction at least to about one to about three times its inside diameter.

9. A device for regulating temperature of radiation and contact heating bodies and electrical cooking apparatus in combination with cooking surfaces consisting of metal, glass ceramics and the like, in which at least one temperature sensor and switch system are provided in order to regulate the temperature of the heating body between the heating body and the cooking surface, said sensor having a rod of high thermal expansion which is disposed in a tube made of low thermal expansion, the switch system being enclosed within a switch housing, one end of the rod being in communication with the switch system which serves to regulate or limit the temperature of the heating body, one end of the tube resting against a side wall of the switch housing, the side wall being oriented approximately perpendicular to the rod, a second end of the rod and a second end of the tube being joined together at a location distant from the switch housing to form the sensor, the improvement wherein the end of the tube which rests against the side wall has a funnel-shaped enlargement in diameter and the side wall has a spherical bulge which extends into the enlargement of the diameter to contact directly the material of the tube so as to form a joint in this region, the bulge having a hole for entry of the one end of the rod into the switch housing, the device including spring means connecting between an interior side of said bulge and the one end of the rod for securing the sensor to the housing, and wherein electrically conducting elements of the switch system are electrically insulated from said sensor, the length of the enlargement of the diameter of the tube corresponds in its longitudinal direction at least to about one to about three times its inside diameter, said rod has a second end opposite the one end of the rod, said tube has a second end opposite the one end of said tube, the second end of said rod joining with the second end of said tube, said device further comprising a spring located within the switch housing and connecting between an interior side of the bulge and the first-mentioned end of said rod, said spring being under compression to urge said tube against said bulge.

* * * * *